US011099495B2

(12) United States Patent
Sawamoto et al.

(10) Patent No.: US 11,099,495 B2
(45) **Date of Patent: *Aug. 24, 2021**

(54) MAGNETIC CORE MATERIAL FOR ELECTROPHOTOGRAPHIC DEVELOPER, CARRIER FOR ELECTROPHOTOGRAPHIC DEVELOPER, DEVELOPER, METHOD FOR PRODUCING MAGNETIC CORE MATERIAL FOR ELECTROPHOTOGRAPHIC DEVELOPER, METHOD FOR PRODUCING CARRIER FOR ELECTROPHOTOGRAPHIC DEVELOPER, AND METHOD FOR PRODUCING DEVELOPER

(71) Applicant: POWDERTECH CO., LTD., Kashiwa (JP)

(72) Inventors: Hiroki Sawamoto, Kashiwa (JP); Tetsuya Uemura, Kashiwa (JP)

(73) Assignee: POWDERTECH CO., LTD., Kashiwa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/641,987

(22) PCT Filed: Mar. 6, 2018

(86) PCT No.: PCT/JP2018/008658

§ 371 (c)(1),
(2) Date: Feb. 25, 2020

(87) PCT Pub. No.: WO2019/038963

PCT Pub. Date: Feb. 28, 2019

(65) Prior Publication Data

US 2021/0080847 A1 Mar. 18, 2021

(30) Foreign Application Priority Data

Aug. 25, 2017 (JP) ..... JP2017-162631

(51) Int. Cl.
*G03G 9/08* (2006.01)
*G03G 9/107* (2006.01)
*G03G 9/113* (2006.01)

(52) U.S. Cl.
CPC ..... *G03G 9/1085* (2020.08); *G03G 9/081* (2013.01); *G03G 9/0817* (2013.01); *G03G 9/107* (2013.01);
(Continued)

(58) Field of Classification Search
CPC ..... G03G 9/107; G03G 9/1131
(Continued)

(56) References Cited

U.S. PATENT DOCUMENTS 6,143,456 A 11/2000 Silence et al.
10,754,271 B2 * 8/2020 Sawamoto ..... G03G 9/107
(Continued)

FOREIGN PATENT DOCUMENTS

JP S64038759 A 2/1989
JP 2005106999 A 4/2005
(Continued)

OTHER PUBLICATIONS

International Search Report and Written Opinion for related PCT App No. PCT/JP2018/008658 dated Apr. 24, 2018, 10 pgs.
Office Action for related JP App No. 2017-162631 dated Nov. 2, 2017, 3 pgs.

*Primary Examiner* — Mark A Chapman
(74) *Attorney, Agent, or Firm* — Procopio, Cory, Hargreaves & Savitch LLP

(57) ABSTRACT

To provide a magnetic core material and carrier for electrophotographic developer, which have small environmental dependence of the electric resistance, can suppress the carrier scattering, and can stably provide good images; a developer contains the carrier; and methods for producing them. The magnetic core material satisfying a value of
(Continued)

Formula (1): a+b×10+c+d+e+f, being from 20 to 150, when a fluoride ion amount is denoted by a (ppm), a chloride ion amount is denoted by b (ppm), a bromide ion amount is denoted by c (ppm), a nitrite ion amount is denoted by d (ppm), a nitrate ion amount is denoted by e (ppm), and a sulfate ion amount is denoted by f (ppm), which are measured by a combustion ion chromatography method.

12 Claims, 2 Drawing Sheets

(52) U.S. Cl.
CPC ..... *G03G 9/1075* (2013.01); *G03G 9/1131* (2013.01); *G03G 9/1132* (2013.01)

(58) Field of Classification Search
USPC ..... 430/111.3, 111.31
See application file for complete search history.

(56) References Cited

U.S. PATENT DOCUMENTS

| | | | |
|---|---|---|---|
| 2009/0246526 | A1 | 10/2009 | Sugiura et al. |
| 2010/0055601 | A1 | 3/2010 | Sugiura et al. |
| 2011/0244389 | A1 | 10/2011 | Kojima et al. |
| 2013/0078567 | A1 | 3/2013 | Shimizu et al. |

FOREIGN PATENT DOCUMENTS

| | | | |
|---|---|---|---|
| JP | 2009234839 | A | 10/2009 |
| JP | 2010055014 | A | 3/2010 |
| JP | 2011227452 | A | 11/2011 |
| JP | 2012181398 | A | 9/2012 |
| JP | 2013072890 | A | 4/2013 |
| JP | 2016025288 | A | 2/2016 |
| JP | 2016224237 | A | 12/2016 |
| WO | 2017175646 | A1 | 10/2017 |

* cited by examiner

[FIG. 1]
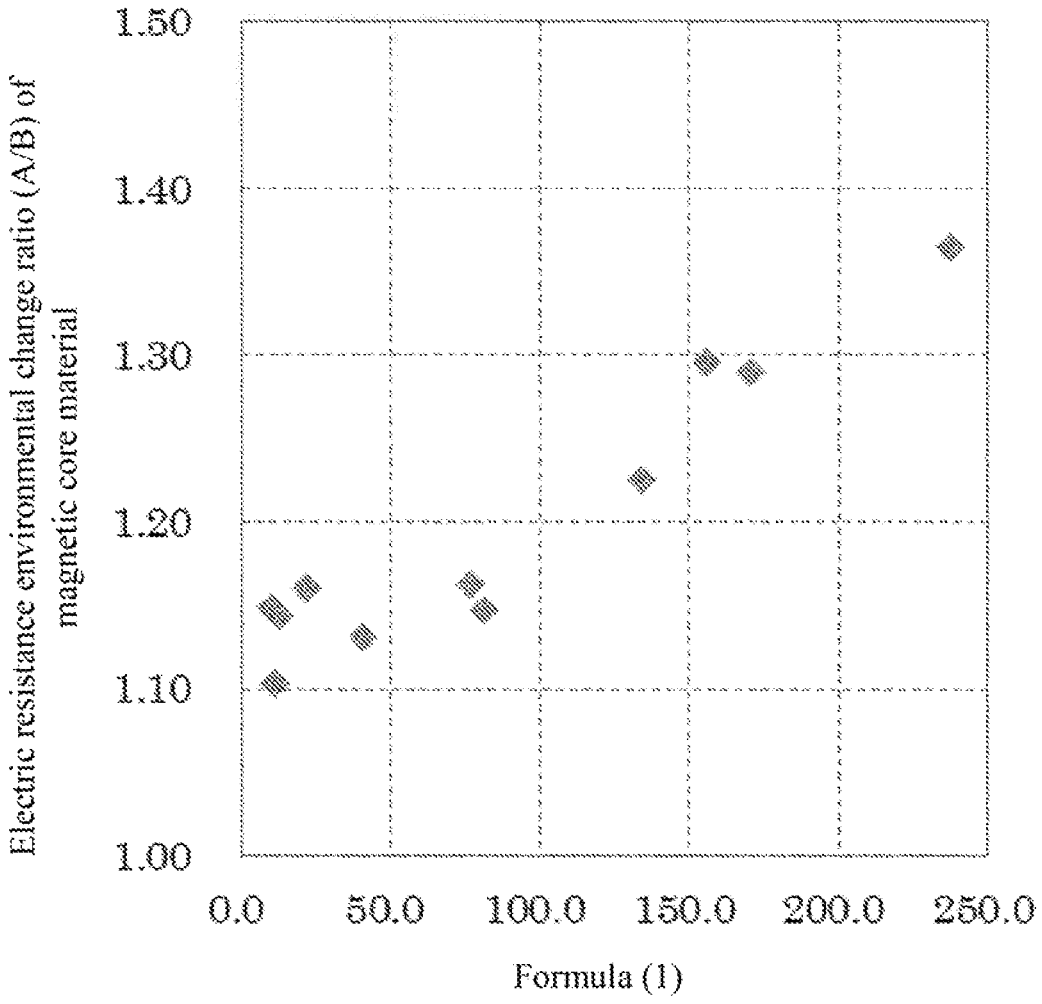

[FIG. 2]
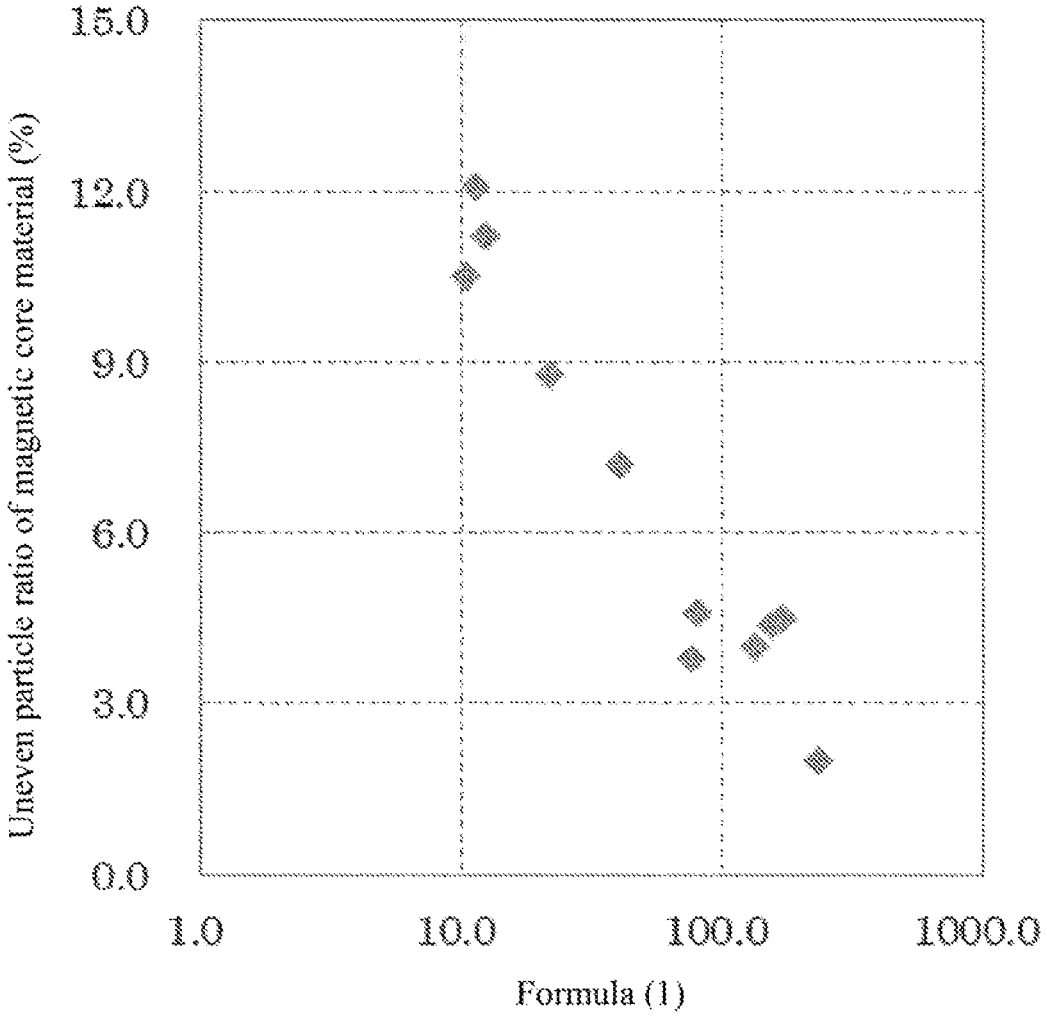

MAGNETIC CORE MATERIAL FOR ELECTROPHOTOGRAPHIC DEVELOPER, CARRIER FOR ELECTROPHOTOGRAPHIC DEVELOPER, DEVELOPER, METHOD FOR PRODUCING MAGNETIC CORE MATERIAL FOR ELECTROPHOTOGRAPHIC DEVELOPER, METHOD FOR PRODUCING CARRIER FOR ELECTROPHOTOGRAPHIC DEVELOPER, AND METHOD FOR PRODUCING DEVELOPER

CROSS-REFERENCE TO RELATED APPLICATIONS

This application is a U.S. National Stage entry of PCT Application No: PCT/JP2018/008658 filed on Mar. 6, 2018, which claims priority to Japanese Patent Application No. 2017-162631, filed Aug. 25, 2017, the contents of which are incorporated herein by reference.

TECHNICAL FIELD

The present invention relates to a magnetic core material for electrophotographic developer, a carrier for electrophotographic developer, a developer, a method for producing the magnetic core material for electrophotographic developer, a method for producing the carrier for electrophotographic developer, and a method for producing the developer.

BACKGROUND ART

The electrophotographic development method is a method in which toner particles in a developer are made to adhere to electrostatic latent images formed on a photoreceptor to develop the images. The developer used in this method is classified into a two-component developer composed of a toner particle and a carrier particle, and a one-component developer using only a toner particle.

As a development method using the two-component developer composed of a toner particle and a carrier particle among those developers, a cascade method and the like were formerly employed, but a magnetic brush method using a magnet roll is now in the mainstream. In the two-component developer, a carrier particle is a carrier substance which is agitated with a toner particle in a development box filled with the developer to impart a desired charge to the toner particle, and further transports the charged toner particle to a surface of a photoreceptor to form toner images on the photoreceptor. The carrier particle remaining on a development roll to hold a magnet is again returned from the development roll to the development box, mixed and agitated with a fresh toner particle, and used repeatedly in a certain period.

In the two-component developer, unlike a one-component developer, the carrier particle has functions of being mixed and agitated with a toner particle to charge the toner particle and transporting the toner particle to a surface of a photoreceptor, and it has good controllability on designing a developer. Therefore, the two-component developer is suitable for using in a full-color development apparatus requiring a high image quality, a high-speed printing apparatus requiring reliability for maintaining image and durability, and the like. In the two-component developer thus used, it is needed that image characteristics such as image density, fog, white spots, gradation, and resolving power exhibit predetermined values from the initial stage, and additionally these characteristics do not vary and are stably maintained during the durable printing period (i.e., a long period of time of use). In order to stably maintain these characteristics, characteristics of a carrier particle contained in the two-component developer need to be stable.

As a carrier particle forming the two-component developer, an iron powder carrier such as an iron powder covered on its surface with an oxide film or an iron powder coated on its surface with a resin, has conventionally been used. However, since such an iron powder carrier has a true specific gravity as heavy as about 7.8 and has a too high magnetization, agitation and mixing thereof with a toner particle in a development box is liable to generate fusing of toner-constituting components on the iron powder carrier surface, that is, so-called toner spent. Such generation of toner spent reduces an effective carrier surface area, and is liable to decrease the frictional chargeability to a toner particle. In addition, in a resin-coated iron powder carrier, a resin on the surface is peeled off due to agitation stress during the durable printing or mechanical stress such as collision of particles with each other, impact, friction, or stress occurred between particles in a development box, and a core material (iron powder) having a high conductivity and a low dielectric breakdown voltage is exposed, thereby causing the leakage of the charge in some cases. Such leakage of the charge causes the breakage of electrostatic latent images formed on a photoreceptor and the generation of brush streaks on solid portions, thus hardly providing uniform images. For these reasons, the iron powder carrier such as an oxide film-covered iron powder and a resin-coated iron powder has not been used currently.

In recent years, in place of the iron powder carrier, a ferrite carrier having a true specific gravity as light as about 5.0 and also has a low magnetization, and a resin-coated ferrite carrier having a resin coated on its surface have often been used, whereby the developer life has been remarkably prolonged. A method for producing such a ferrite carrier generally involves mixing ferrite carrier raw materials in predetermined amounts, thereafter calcining and pulverizing the mixture, and granulating and thereafter sintering the resultant. The calcination may be omitted in some cases, depending on the condition.

Recently, networking of offices progresses, and the time changes from a single-function copying machine to a multifunctional machine. In addition, a service system also shifts from a system where a service person who contracts to carry out regular maintenance and to replace a developer or the like to the time of a maintenance-free system. The demand for further extending the life of the developer from the market is increasing more and more.

Under these circumstances, in order to attempt to improve carrier characteristics, it has been proposed to control a shape or an amount of impurities of carrier core material. For example, Patent Literature 1 (JP-A-2005-106999) proposes a carrier for electrostatic latent image developer containing a magnetic carrier core material having a specific resin coating layer formed on its surface, in which the magnetic carrier core material has an envelope coefficient A represented by formula (1): $A=[(L_1-L_2)/L_2]\times 100$ (in the formula, $L_1$ represents an outer peripheral length of projection image of the carrier core material, and $L_2$ represents a length of envelope of projection image of the carrier core material) satisfying relation of $A<4.5$. This carrier is described to have a stable charging imparting ability for a long period of time and an effect of suppressing occurrence of carrier adhesion or the like. In particular, it is described that by setting the envelope coefficient A to be low, uneven distribution of resin on the surface of core material is decreased to make the resin layer uniform, exposure of the core material due to wear with time decreases and carrier adhesion to the non-image area due to charge injection from the carrier hardly occurs.

In addition, Patent Literature 2 (JP-A-2012-181398) proposes a ferrite carrier core material for electrophotographic developer having a magnetization by VSM measurement when applied a magnetic field of $1K \cdot 1000/4\pi \cdot A/m$ being from 50 to 65 $Am^2/kg$, a BET specific surface area being from 0.12 to 0.30 $m^2/g$, an average particle diameter being from 20 to 35 μm, and a perimeter/envelope length in number distribution satisfying the range in which 1.02 or more and less than 1.04 is from 75% by number to 90% by number and 1.04 or more and less than 1.06 is 20% by number or less. This carrier core material is described to have excellent charging property and an effect of suppressing occurrence of carrier scattering. In particular, it is described that by setting the perimeter/envelope length to be within the specific range, the carrier is suppressed from being low in resistance to scatter, which is caused as a result of a resin coated on the convex portion of the carrier peeling preferentially due to agitation in a developing machine. In addition, it is described to reduce a chlorine amount and described that in the case where the carrier core material contains chlorine, the chlorine adsorbs moisture in use environment to influence on electrical characteristics including the charging amount.

Moreover, Patent Literature 3 (JP-A-2016-025288) proposes a ferrite magnetic material containing Fe as a main component and an additional element such as Mn, in which an average particle diameter is from 1 to 100 μm, the total amount of impurities in the ferrite magnetic material excluding Fe, the additional element and oxygen is 0.5% by mass or less, and the impurities include at least two selected from Si, Al, Cr, Cu, P, Cl, Ni, Mo, Zn, Ti, sulfur, Ca, Mn, and Sr. It is described that a magnetic carrier using the ferrite magnetic material, in which influence of the impurities in the raw materials is suppressed, as a magnetic carrier core material for electrophotographic developer, has high magnetic force and an effect of suppressing the carrier scattering.

CITATION LIST

Patent Literature

Patent Literature 1: JP-A-2005-106999
Patent Literature 2: JP-A-2012-181398
Patent Literature 3: JP-A-2016-025288

SUMMARY OF INVENTION

As described above, the attempts for improving the carrier characteristics by controlling a shape of carrier core material or an amount of impurities have been known, but, there is a problem in that the carrier characteristics are not sufficient for further demands of high image quality and high speed printing in recent years. In particular, it is strongly required not only to reduce the environmental dependence of the electric resistance, but also to further reduce the carrier scattering. This is because when the environmental dependence of the electric resistance is large, the image characteristics such as image density or fog are significantly changed depending on usage environment so that stable image characteristics cannot be obtained. Furthermore, this is because when the carrier scattering is large, white spots occur on the image or the carrier scattered damages a photoreceptor. Characteristics of carrier core material are important in order to improve the carrier characteristics. This is because when the carrier is used for a long period of time, a resin coating layer is peeled off by the wear with time and the core material exposed has a large influence on the characteristics of carrier.

Now, the present inventors have found that the contents of specific anion components measured by a combustion ion chromatography method in a magnetic core material for electrophotographic developer are important for reducing the environmental dependence of the electric resistance and suppressing the carrier scattering. Specifically, it has been found that by appropriately controlling the contents of specific anion components in a magnetic core material for electrophotographic developer, when a carrier or a developer is formed therefrom, a carrier core material which has small environmental dependence of the electric resistance and can effectively suppress the carrier scattering is formed, and as a result, when a carrier or a developer is formed therefrom, good images can be stably provided.

Therefore, an object of the present invention is to provide a magnetic core material for electrophotographic developer which has small environmental dependence of the electric resistance and can suppress the carrier scattering. Another object of the present invention is to provide a carrier for electrophotographic developer and a developer each of which has the magnetic core material. A further object of the present invention is to provide a method for producing the magnetic core material for electrophotographic developer, a method for producing the carrier for electrophotographic developer, and a method for producing the developer.

The objects of the present invention can be solved by the means described below.

[1] A magnetic core material for electrophotographic developer, satisfying a value of Formula (1): $a+b\times10+c+d+e+f$, being from 20 to 150, when a fluoride ion amount is denoted by a (ppm), a chloride ion amount is denoted by b (ppm), a bromide ion amount is denoted by c (ppm), a nitrite ion amount is denoted by d (ppm), a nitrate ion amount is denoted by e (ppm), and a sulfate ion amount is denoted by f (ppm), which are measured by a combustion ion chromatography method.

[2] The magnetic core material for electrophotographic developer according to [1], in which in a number distribution of a ratio A of a perimeter to an envelope perimeter, a ratio of particles having the ratio A of 1.08 or more is 10% or less.

[3] The magnetic core material for electrophotographic developer according to [1] or [2], in which the value of Formula (1) is from 30 to 100.

[4] The magnetic core material for electrophotographic developer according to [2], in which the ratio of particles having the ratio A of 1.08 or more is 8% or less.

[5] The magnetic core material for electrophotographic developer according to any one of [1] to [4], in which the magnetic core material has a volume average particle diameter ($D_{50}$) being from 25 to 50 μm, and an apparent density (AD) being from 2.0 to 2.7 $g/cm^3$.

[6] The magnetic core material for electrophotographic developer according to any one of [1] to [5], in which the magnetic core material has a ferrite composition containing at least one element selected from Mn, Mg, Li, Sr, Si, Ca, Ti, and Zr.

[7] A carrier for electrophotographic developer containing the magnetic core material for electrophotographic developer as described in any one of [1] to [6] and a coating layer containing a resin provided on a surface of the magnetic core material.

[8] A developer containing the carver as described in [7] and a toner.

[9] A method for producing the magnetic core material for electrophotographic developer as described in any one of [1] to [6], in which the method includes the following steps:

a step of pulverizing and mixing raw materials of the magnetic core material to produce a pulverized product, a step of calcining the pulverized product to produce a calcined product, a step of pulverizing and granulating the calcined product to produce a granulated product, a step of sintering the granulated product to produce a sintered product, and a step of disintegrating and classifying the sintered product; and in which in the production of the granulated product, a washing operation is performed in a manner that water is added to the calcined product, followed by performing wet pulverization to form a slurry, and after dehydrating the slurry obtained, water is added again, followed by performing wet pulverization.

[10] The method for producing the magnetic core material for electrophotographic developer according to [9], in which in the washing operation, a step of adding water after dehydration of the slurry, followed by performing wet pulverization is repeated.

[11] A method for producing a carrier for electrophotographic developer including:

producing a magnetic core material by the method as described in [9] or [10] and then, coating a surface of the magnetic core material with a resin.

[12] A method for producing a developer including:

producing a carrier by the method as described in [11] and then, mixing the carrier with a toner.

BRIEF DESCRIPTION OF DRAWINGS

FIG. 1 It shows a relation between the value of Formula (1) in a magnetic core material and the electric resistance environmental change ratio (A/B).

FIG. 2 It shows a relation between the value of Formula (1) in a magnetic core material and, in a number distribution of a ratio A of perimeter to envelope perimeter, the ratio (uneven particle ratio) of particles having the ratio A of 1.08 or more.

DESCRIPTION OF EMBODIMENTS

In the specification, a numerical value range represented by using "to" means a range including numerical values given before and after "to" as a lower limit value and an upper limit value, respectively.

The magnetic core material for electrophotographic developer is a particle capable of being used as a carrier core material, and the carrier core material is coated with a resin to form a magnetic carrier for electrophotographic developer. An electrophotographic developer is formed by containing the magnetic carrier for electrophotographic developer and a toner.

Magnetic Core Material for Electrophotographic Developer:

The magnetic core material for electrophotographic developer according to the present invention (hereinafter, referred to as a magnetic core material or a carrier core material in some cases) has a feature that the contents of specific anion components measured by a combustion ion chromatography method are controlled within a specific range. Specifically, in the magnetic core material when a fluoride ion amount is denoted by a (ppm), a chloride ion amount is denoted by b (ppm), a bromide ion amount is denoted by c (ppm), a nitrite ion amount is denoted by d (ppm), a nitrate ion amount is denoted by e (ppm), and a sulfate ion amount is denoted by f (ppm), the value of Formula (1): $a+b\times10+c+d+e+f$, is from 20 to 150. According to such a magnetic core material, a carrier which has small environmental dependence of the electric resistance and a small carrier scattering can be obtained. In the case where the value of Formula (1) exceeds 150, the environmental dependence of the electric resistance increases. This is because as the contents of specific anion components (hereinafter, simply referred to as anion components in some cases) increases, the electric resistance of the magnetic core material largely changes when environment is changed. The reason for this is considered that since the anion components are easy to absorb environmental moisture, whereby a moisture content of magnetic core material increases particularly under high temperature and high humidity conditions to increase ion conductivity and as a result, the electric resistance of the core material decreases. On the other hand, in the case where the value of Formula (1) is less than 20, mutual sintering of particles is liable to occur during the sintering and the ratio of production of particles (magnetic core material) having large surface unevenness increases and as a result, the sufficient effect of suppressing the carrier scattering cannot be achieved. In addition, in order to produce the magnetic core material having the value of Formula (1) of less than 20, it is necessary to use a raw material having extremely high quality (low contents of anion components) or to pass through a specific step for increasing the quality and thus, there is a problem of poor productivity. The value of Formula (1) is preferably from 25 to 130, and particularly preferably from 30 to 100. Furthermore, in the magnetic core material, a value of Formula (2): $b\times10+f$, is preferably from 15 to 130, more preferably from 20 to 110, and still more preferably from 25 to 90.

The contents of anion components (ppm) are on a weight basis.

The combustion ion chromatography method is a technique in which a sample is burned in oxygen-containing gas flow, the gas generated is absorbed in an adsorption solution and then, a halogen or a sulfate ion adsorbed in the adsorption solution is quantitatively analyzed by an ion chromatography method. The technique makes it possible to easily analyze a halogen or sulfur component in ppm order which has been conventionally difficult. The contents of anion components are values measured by the combustion ion chromatography method, but the detection of an anion component does not mean that it is limited to that contained in the form of an anion in the magnetic core material. For example, even when a sulfate ion is detected by a combustion ion chromatography method, it does not mean to be limited to that the magnetic core material contains a sulfur component in the form of a sulfate ion, and the sulfur component may be contained in the form of elemental sulfur, a metal sulfide, a sulfate ion, other sulfides or the like.

The values of the contents of anion components described in the specification are values measured by the combustion ion chromatography method under the conditions described in Examples described later.

The content of a cation component in the magnetic core material can be measured by emission spectroscopy. The value of the content of a cation component described in the specification is a value measured by ICP emission spectroscopy (high-frequency inductively coupled plasma emission spectroscopy) under the conditions described in Examples described later.

As to the magnetic core material, in a number distribution of a ratio A of perimeter to envelope perimeter, a ratio of particles having the ratio A of 1.08 or more (hereinafter, "uneven particle ratio") is preferably 10% or less, more preferably 9% or less, and still more preferably 8% or less. The lower limit of the uneven particle ratio is not particularly limited and is typically 0.1% or more. Furthermore, as to the magnetic core material, an average value of the ratio A is preferably from 1.01 to 1.07, more preferably from 1.02 to 1.06, and still more preferably from 1.03 to 1.05. The ratio A can be determined by the formula shown below.

The values of envelope perimeter and perimeter described in the specification are values obtained by observing 3,000 pieces of magnetic core materials by using a particle size and shape distribution measuring device (PITA-1, produced by Seishin Enterprise Co., Ltd.) under the conditions described in Examples described later and determining by using a software (Image Analysis) associated therewith.

$$\text{Ratio } A = \text{perimeter/envelope perimeter} \quad \text{[Math. 1]}$$

The perimeter is a length of a circumference including unevenness of a projection image of an individual particle constituting the magnetic core material, and the envelope perimeter is a length obtained by connecting the individual convex portions of the projection image by ignoring the concave portions. Since the envelope perimeter is a length obtained by ignoring the concave portions of the particle, a degree of the unevenness of an individual particle constituting the magnetic core material can be evaluated from the ratio between the perimeter and the envelope perimeter. Namely, as the ratio A is close to 1, it means a particle having a small surface unevenness, and as the ratio A is large, it means a particle having a large surface unevenness. Therefore, in the number distribution of the ratio A, as the ratio of particles having the ratio A of 1.08 or more (uneven particle ratio) is small, a ratio of particles having a large surface unevenness in the magnetic core material is decreased.

Decrease in the uneven particle ratio of the magnetic core material is expected to further suppress the carrier scattering. This is because when the magnetic core material is subjected to resin coating to form a carrier, in particles having a large surface unevenness, the resin coating is easily peeled off from the convex portions thereof. Namely, mechanical stress is applied to the carrier by being mixed and agitated with a toner during its use, and in the case where the ratio of particles having a large surface unevenness is large, the resin coating of the carrier is liable to be peeled off due to the mechanical stress. When the resin coating of the carrier is peeled off, resistance of the carrier becomes too low, thereby causing the carrier scattering. Therefore, by decreasing the uneven particle ratio as 10% or less, the effect of suppressing the carrier scattering can be remarkably achieved.

As to the magnetic core material, as long as it functions as a carrier core material, the composition thereof is not particularly limited and conventionally known composition may be used. The magnetic core material typically has a ferrite composition (ferrite core material) and preferably has a ferrite composition containing at least one element selected from Mn, Mg, Li, Sr, Si, Ca, Ti and Zr. On the other hand, in consideration of the recent trend of the environmental load reduction including the waste regulation, it is desirable that heavy metals such as Cu, Zn and Ni are not contained in a content exceeding inevitable impurities (associated impurities) range.

The volume average particle size ($D_{50}$) of the magnetic core material is preferably from 25 to 50 μm, more preferably from 30 to 45 μm, and still more preferably 36 to 45 μm. In the case where the volume average particle size is 25 μm or more, the carrier adhesion can be sufficiently suppressed. On the other hand, in the case of 50 μm or less, image degradation due to decrease in charging imparting ability can be further suppressed.

The apparent density (AD) of the magnetic core material is preferably from 2.0 to 2.7 g/cm$^3$, and more preferably from 2.1 to 2.6 g/cm$^3$. In the case where the apparent density is 2.0 g/cm$^3$ or more, excessive weight saving of the carrier is suppressed and the charging imparting ability is further improved. On the other hand, in the case of 2.7 g/cm$^3$ or less, the effect of weight saving of the carrier is sufficient and durability is further improved.

In addition, as to the magnetic core material, the electric resistance environmental change ratio (A/B) is preferably 1.25 or less, more preferably 1.23 or less, and still more preferably 1.20 or less. The lower limit of the electric resistance environmental change ratio (A/B) is not particularly limited and is typically 1.05 or more. Here, the electric resistance environmental change ratio (A/B) is an index indicating electric resistance change depending on environmental difference, and is obtained as a ratio of a logarithmic value (Log $R_{L/L}$) of electric resistance $R_{L/L}$ (unit: Ω) under low temperature/low humidity (L/L) environment to a logarithmic value (Log $R_{H/H}$) of electric resistance $R_{H/H}$ (unit: Ω) under high temperature/high humidity (H/H) environment, of the magnetic core material, as shown in the formula below.

$$A/B = \text{Log } R_{L/L} / \text{Log } R_{H/H} \quad \text{[Math. 2]}$$

In the case where the electric resistance environmental change ratio (A/B) is set to 1.25 or less, the environmental dependence of the electric resistance of the core material can be reduce and the occurrence of image defects caused by the change in use environment can be sufficiently suppressed. The H/H environment represents an environment of temperature from 30 to 35° C. and relative humidity from 80 to 85%, and the L/L environment represents an environment of temperature from 10 to 15° C. and relative humidity from 10 to 15%. The logarithmic value represents a common logarithmic value.

As described above, the magnetic core material (carrier core material) for electrophotographic developer of the present invention can form a carrier which can reduce the environmental dependence of the electric resistance, can be suppressed the carrier scattering, and can stably provide good images, by controlling the contents of specific anion components measured by a combustion ion chromatography method. As long as the present inventors know, the technique of controlling the contents of anion components has not been conventionally known. For example, in Patent Literature 2, although the Cl elution amount of the carrier core material is described, influence of anions other than Cl is not mentioned. In addition, the elution method is a technique for measuring concentration of components present on the surface of particle and is completely different from the ion chromatography method in the measurement principle. Furthermore, in Patent Literature 3, the total amount of impurities in the ferrite magnetic material is defined, but this literature only focuses on decreasing the total amount of the impurities as much as possible and does not teach to control the contents of specific anion components to the specific range. In addition, there is no description about the environmental dependence of the electric resistance.

Carrier for Electrophotographic Developer:

The carrier for electrophotographic developer (simply referred to as a carrier in some cases) of the present invention contains the magnetic core material (carrier core material) described above and a coating layer containing a resin provided on the surface of the magnetic core material. The carrier characteristics may by influenced by materials present on the surface of the carrier or properties thereof. Therefore, by coating an appropriate resin on the surface, the desired carrier characteristics can be accurately provided.

The coating resin is not particularly limited. Examples thereof include a fluorine resin, an acrylic resin, an epoxy resin, a polyamide resin, a polyamide imide resin, a polyester resin, an unsaturated polyester resin, a urea resin, a melamine resin, an alkyd resin, a phenol resin, a fluoroacrylic resin, an acryl-styrene resin, a silicone resin, and a modified silicone resin modified with a resin such as an acrylic resin, a polyester resin, an epoxy resin, a polyamide resin, a polyamide imide resin, an alkyd resin, a urethane resin, or a fluorine resin, and the like. In consideration of elimination of the resin due to the mechanical stress during usage, a thermosetting resin is preferably used. Specific examples of the thermosetting resin include an epoxy resin, a phenol resin, a silicone resin, an unsaturated polyester resin, a urea resin, a melamine resin, an alkyd resin, resins containing them, and the like. The coating amount of the resin is preferably from 0.1 to 5.0 parts by weight with respect to 100 parts by weight of the magnetic core material (before resin coating).

Furthermore, in order to control the carrier characteristics, a conductive agent or a charge control agent may be incorporated into the coating resin. Examples of the conductive agent include conductive carbon, an oxide such as titanium oxide or tin oxide, various types of organic conductive agents, and the like. The addition amount thereof is from 0.25 to 20.0% by weight, preferably from 0.5 to 15.0% by weight, and particularly preferably from 1.0 to 10.0% by weight, with respect to the solid content of the coating resin. Examples of the charge control agent include various types of charge control agents commonly used for toner, and various types of silane coupling agents. The kinds of the charge control agents and coupling agents usable are not particularly limited, and preferred are a charge control agent such as a nigrosine dye, a quaternary ammonium salt, an organic metal complex, or a metal-containing monoazo dye, an aminosilane coupling agent, a fluorine-based silane coupling agent, and the like. The addition amount thereof is preferably from 1.0 to 50.0% by weight, more preferably from 2.0 to 40.0% by weight, and particularly preferably from 3.0 to 30.0% by weight, with respect to the solid content of the coating resin.

As to the carrier, the electric resistance environmental change ratio (C/D) is preferably 1.25 or less, and more preferably 1.20 or less. The electric resistance environmental change ratio (C/D) is obtained as a ratio of a logarithmic value (Log $R_{L/L}$) of electric resistance $R_{L/L}$ (unit: Ω) under the low temperature/low humidity (L/L) environment to a logarithmic value (Log $R_{H/H}$) of electric resistance $R_{H/H}$ (unit: Ω) under the high temperature/high humidity (H/H) environment, of the carrier, as shown in the formula below.

$$C/D = \text{Log } R_{L/L} / \text{Log } R_{H/H} \quad \text{[Math. 3]}$$

In the case where the electric resistance environmental change ratio (C/D) is set to 1.25 or less, the environmental dependence of the electric resistance of the carrier can be reduce and the occurrence of image defects caused by the change in use environment can be sufficiently suppressed. The lower limit of the electric resistance environmental change ratio (C/D) is not particularly limited and is typically 1.05 or more.

Methods for Producing Magnetic Core Material for Electrophotographic Developer and Carrier for Electrophotographic Developer:

In producing a carrier for electrophotographic developer of the present invention, first, a magnetic core material for electrophotographic developer is produced. For producing the magnetic core material, primary materials (raw materials) are weighed in appropriate amounts, and then pulverized and mixed by a ball mill, a vibration mill or the like for 0.5 hours or more, preferably from 1 to 20 hours. The raw materials are not particularly limited. The pulverized product thus-obtained is pelletized by using a compression molding machine or the like, and then calcined at temperature from 700 to 1,200° C. to obtain a calcined product.

Then, the calcined product is pulverized by a ball mill, a vibration mill or the like. At this time, a wet pulverization in which water is added to the calcined product to form a slurry may be performed, and if desired, a dispersant, a binder or the like may be added to adjust a viscosity of the slurry. Furthermore, by regulating the size and composition of the media used in the pulverization, the pulverization time and the like, the degree of pulverization can be controlled. Then, the calcined product pulverized is granulated by a spray dryer to perform granulation, thereby obtaining a granulated product.

Furthermore, the granulated product thus-obtained is heated at 400 to 800° C. to remove the organic components such as the dispersant or binder added, and then maintained in an oxygen concentration controlled atmosphere at temperature from 800 to 1,500 for 1 to 24 hours to perform sintering. At this time, a rotary electric furnace, a batch electric furnace, a continuous electric furnace, or the like may be used, and the control of the oxygen concentration may be performed by introducing an inert gas such as nitrogen or a reducing gas such as hydrogen or carbon monoxide into the atmosphere at the time of sintering. Then, the sintered product thus-obtained is disintegrated and classified. Examples of the disintegration method include a method using a hammer crusher or the like. As the classification method, the existing method such as an air classification method, a mesh filtration method or a precipitation method may be used to regulate the particle size to an intended particle size.

Thereafter, if desired, an oxide film forming treatment can be performed by applying low temperature heating to the surface, thereby regulating the electric resistance. The oxide film forming treatment can be performed by heat treatment, for example, at 300 to 700° C. by using a common rotary electric furnace, batch electric furnace or the like. The thickness of the oxide film formed by the treatment is preferably from 0.1 nm to 5 μm. In the case of 0.1 nm or more, the effect of the oxide film layer is sufficient. In the case of 5 μm or less, decrease in the magnetization or the excessively high resistance can be suppressed. If desired, reduction may be performed before the oxide film forming treatment.

As the method for adjusting the contents of anion components measured by a combustion ion chromatography method in a magnetic core material, various techniques can be mentioned. Examples thereof include using a raw material having small contents of the anion components, and performing washing operation in the stage of slurry (suspension composed of calcined product and water) before granulating. In addition, it is also effective to increase a flow rate of atmospheric gas introduced into a furnace at the time of calcination or sintering to make the anions be easily discharged outside the system. In particular, the washing operation of slurry is preferably performed, and this can be performed, for example, by a technique in which after dehydration of the slurry, water is added again and wet pulverization is performed. In order to reduce the contents of anion components, the dehydration and re-pulverization may be repeated.

As described later, in Examples, as an example of the technique for reducing the anion components, in the production of the granulated product, water is added to the calcined product, followed by performing wet pulverization to form a slurry, and after dehydrating the slurry obtained, a washing operation in which water is added again, followed by performing wet pulverization is performed. In addition, in the washing operation, the step of adding water after dehydration of the slurry, followed by performing wet pulverization may be repeated.

This is because the anion components elute from the calcined product into water at the time of pulverization and the anion components eluted are discharged together with water at the time of dehydration, and as a result, the anion components in the magnetic core material are reduced. In addition, it is also effective to adjust various conditions in the washing operation in order to set the value of Formula (1): $a+b\times10+c+d+e+f$, to be within the range of the present invention, when a fluoride ion amount is denoted by a (ppm), a chloride ion amount is denoted by b (ppm), a bromide ion amount is denoted by c (ppm), a nitrite ion amount is denoted by d (ppm), a nitrate ion amount is denoted by e (ppm), and a sulfate ion amount is denoted by f (ppm), which are measured by a combustion ion chromatography method. Examples of adjustment means include appropriate adjustment of purity of washing water depending on purity of raw material, temperature of washing water, addition amount of water with respect to a calcined product (diluted concentration), washing time, stirring strength during the washing (degree of dispersion), dehydration level (concentrated concentration), the number of times of washing, and the like.

Only by washing according to a simple method without adjusting the detailed conditions during the washing, it is absolutely difficult to achieve the value of Formula (1): $a+b\times10+c+d+e+f$, to be within the range of the present invention.

Furthermore, as described above, in a technique in which the dehydration operation, which is one example of the method for reducing the anion components according to the present invention, is not performed, the anion components eluted at the time of the pulverization are again dried without being discharged. As a result, it is inferred that a great part of the anion components remains in the granulated powder, and as described above, the value of Formula (1): $a+b\times10+c+d+e+f$, cannot be adjust to be within the specific range.

As described above, it is desired that after the production of the magnetic core material, the surface of the magnetic core material is coated with a resin to from a carrier. The coating resin used is that described above. As a coating method, use can be made of a known method, for example, a brush coating method, a dry method, a spray dry system using a fluidized bed, a rotary dry system, or a dip-and-dry method using a universal agitator. In order to improve the surface coverage, the method using a fluidized bed is preferred. In the case where the resin is baked after the coating, any of an external heating system and an internal heating system may be employed, and, for example, a fixed or fluidized electric furnace, a rotary electric furnace or a burner furnace can be used. Alternatively, the baking with a microwave may be used. In the case where a UV curable resin is used as the coating resin, a UV heater is employed. The temperature for baking is varied depending on the resin used, and is desirably a temperature equal to or higher than the melting point or the glass transition point. For a thermosetting resin, a condensation-crosslinking resin or the like, the temperature is desirably raised to a temperature at which the curing sufficiently progresses.

Developer:

The developer according to the present invention contains the carrier for electrophotographic developer described above and a toner. The particulate toner (toner particle) constituting the developer includes a pulverized toner particle produced by a pulverizing method and a polymerized toner particle produced by a polymerization method. As the toner particle used in the present invention, the toner particles obtained by any method can be used. The developer according to the present invention prepared as described above can be used in a copying machine, a printer, a FAX machine, a printing machine, and the like, which use a digital system employing a development system in which an electrostatic latent image formed on a latent image holder having an organic photoconductive layer is reversely developed with a magnetic brush of a two-component developer containing a toner and a carrier while applying a bias electric field. Furthermore, the developer is also applicable to a full-color machine and the like using an alternative electric field, which is a method in which when applying a development bias from a magnetic brush to an electrostatic latent image side, an AC bias is superimposed on a DC bias.

EXAMPLE

The present invention will be described more specifically with reference to the examples below.

Example 1

(1) Production of Magnetic Core Material

Raw materials were weighed so as to attain a composition ratio after sintering being 20% by mole of MnO and 80% by mole of $Fe_2O_3$, water was added thereto, and the mixture was pulverized and mixed by a wet ball mill for 5 hours, dried, and then maintained at 950° C. for one hour to perform calcination. As the MnO raw material and the $Fe_2O_3$ raw material, 2.7 kg of trimanganese tetraoxide and 22.3 kg of $Fe_2O_3$ were used, respectively.

(1-1) Pulverization of Calcined Product

Water was added to the calcined product thus-obtained, the mixture was pulverized by a wet ball mill for 4 hours, and the resulting slurry was pressed and dehydrated by a belt press machine. To the cake obtained was added water, and the mixture was pulverized again by a wet ball mill for 4 hours to obtain slurry 1.

(1-2) Granulation

To slurry 1 obtained was added PVA (polyvinyl alcohol) (aqueous 20% by weight solution) as a binder in an amount of 0.2% by weight with respect to the solid content, and a polycarboxylic acid dispersant was added so as to attain a slurry viscosity of 2 poise, and then granulated and dried by a spray drier to obtain a granulated product. The particle size control of the granulated product was performed by a gyro shifter. Thereafter, the granulated product was heated at 650° C. in the air by using a rotary electric furnace to remove the organic components such as the dispersant and the binder.

(1-3) Sintering

Then, the granulated product was maintained in an electric furnace at a temperature of 1,310° C. and an oxygen concentration of 0.1% for 4 hours to perform sintering. At this time, the temperature rising rate was set to 150° C./hour and the cooling rate was set to 110° C./hour. In addition, nitrogen gas was introduced from an outlet side of a tunnel-type electric furnace to adjust the internal pressure of the tunnel-type electric furnace from 0 to 10 Pa (positive pressure). Then, the sintered product was disintegrated by a hammer crusher, classified by a gyro shifter and a turbo classifier to perform particle size control, and subjected to magnetic separation to separate a low magnetic force product, thereby obtaining a ferrite particle (magnetic core material).

(2) Production of Carrier

An acrylic resin (BR-52, produced by Mitsubishi Rayon Co., Ltd.) was dissolved in toluene to prepare an acrylic resin solution having a resin concentration of 10%. By using a universal mixing agitator, 100 parts by weight of the ferrite particle (magnetic core material) obtained in (1-3) and 2.5 parts by weight of the acrylic resin solution (0.25 parts by weight as a solid content because of the resin concentration of 10%) were mixed and agitated, thereby coating the resin on the surface of the ferrite particle while volatilizing toluene. After confirming that toluene was thoroughly volatilized, the residue was taken out from the apparatus, put into a vessel, and subjected to heating treatment at 150° C. for 2 hours in a hot air heating oven. Then, the product was cooled to room temperature, and the ferrite particle with the resin cured was taken out, the particles were disaggregated by using a vibrating sieve having an opening size of 200 mesh, and the non-magnetic material was removed by a magnetic separator. Thereafter, coarse particles were removed by again using the vibrating sieve having an opening size of 200 mesh, to obtain a ferrite carrier coated with resin.

(3) Evaluation

As to the magnetic core material and carrier obtained, evaluations of various characteristics were made in the manner described below.

<Volume Average Particle Size>

The volume average particle size ($D_{50}$) of the magnetic core material was measured by using a micro-track particle size analyzer (Model 9320-X100, produced by Nikkiso Co., Ltd.). Water was used as a dispersion medium. First, 10 g of a sample and 80 ml of water were put into a 100-ml beaker and a few drops of a dispersant (sodium hexametaphosphate) was added thereto. Subsequently, the mixture was dispersed for 20 seconds by using an ultrasonic homogenizer (UH-150 Model, produced by SMT. Co., Ltd.) at an output power level set at 4. Thereafter, foams formed on a surface of the beaker were removed, and the sample was loaded in the analyzer to perform the measurement.

<Apparent Density>

The apparent density (AD) of the magnetic core material was measured in accordance with JIS Z2504 (Test Method for Apparent Density of Metal Powders).

<Ion Content>

The measurement of the contents of anion components in the magnetic core material was performed by quantitative analysis of the anion components included in the ferrite particle with a combustion ion chromatography under the conditions described below.

Combustion equipment: AQF-2100H, produced by Mitsubishi Chemical Analytic Tech Co., Ltd.)
Sample amount: 50 mg
Combustion temperature: 1,100° C.
Combustion time: 10 minutes
Ar flow rate: 400 ml/min
$O_2$ flow rate: 200 ml/min
Humidified air flow rate: 100 ml/min
Absorption solution: Solution prepared by adding 1% by weight of hydrogen peroxide to the eluent described below
Analysis equipment: IC-2010, produced by Tosoh Corp.
Column: TSKgel SuperIC-Anion HS (4.6 mm I.D.×1 cm+4.6 mm I.D.×10 cm)
Eluent: Aqueous solution prepared by dissolving 3.8 mmol of $NaHCO_3$ and 3.0 mmol of $Na_2CO_3$ in 1 L of pure water
Flow rate: 1.5 mL/min
Column temperature: 40° C.
Injection volume: 30 μL
Measurement mode: Suppressor system
Detector: CM detector
Standard sample: Anion mixed standard solution produced by Kanto Chemical Co., Inc.

The measurement of the contents of cation components in the magnetic core material was performed in the following manner. First, an acid solution was added to the ferrite particle (magnetic core material), and the mixture was heated to completely dissolve the ferrite particle. Next, quantitative analysis of the solution obtained was performed by using ICP emission spectroscopy (ICPS-1000IV, produced by Shimadzu Corp.), and the result of analysis was converted to the content of the ferrite particle.

<Electric Resistance>

The electric resistance characteristics of the magnetic core material and carrier under normal temperature and normal humidity (N/N) environment, under high temperature and high humidity (H/H) environment and under low temperature and low humidity (L/L) environment were measured in the manner described below, respectively.

First, the electric resistance ($R_{N/N}$) of the magnetic core material under the N/N environment was measured in the following manner. Namely, non-magnetic parallel flat plate electrodes (10 mm×40 mm) were placed to be opposed to each other with an interval between the electrodes of 6.5 mm, and 200 mg of a sample was weighed and filled therebetween. Next, magnets (surface magnetic flux density: 1,500 Gauss, area of the magnets brought into contact with the electrodes: 10 mm×30 mm) were attached to the parallel flat plate electrodes to hold the sample between the electrodes, a voltage of 100 V was applied, and the electric resistance $R_{N/N}$ (unit: Ω) was measured by an insulation resistance tester (SM-8210, produced by DKK-TOA Corp.) to obtain the logarithmic value thereof (Log $R_{N/N}$). The term "under normal temperature and normal humidity" as used herein means an environment of a room temperature from 20 to 25° C. and a humidity from 50 to 60%, and the measurement described above was performed after the sample had been exposed in a constant temperature and humidity room controlled at the room temperature and the humidity described above for 12 hours or more.

The electric resistance ($R_{H/H}$) of the magnetic core material under the H/H environment was measured in the following manner. Namely, after a sample was exposed for 12 hours or more in a room where a room temperature and a humidity were controlled under the H/H environment of a temperature from 30 to 35° C. and a relative humidity from 80 to 85%, the electric resistance $R_{H/H}$ (unit: Ω) was measured in the same manner as in the electric resistance under the normal temperature and normal humidity described above, to obtain the logarithmic value thereof (Log $R_{H/H}$). At this time, the interval between the electrodes was set to 6.5 mm, and the applied voltage was set to 100 V.

The electric resistance ($R_{L/L}$) of the magnetic core material under the L/L environment was measured in the following manner. Namely, after a sample was exposed for 12 hours or more in a room where a room temperature and a humidity were controlled under the L/L environment of a temperature from 10 to 15° C. and a relative humidity from 10 to 15%, the electric resistance $R_{L/L}$ (unit: Ω) was measured in the same manner as in the electric resistance under the normal temperature and normal humidity described above, to obtain the logarithmic value thereof (Log $R_{L/L}$). At this time, the interval between the electrodes was set to 6.5 mm, and the applied voltage was set to 100 V.

Then, by using the Log $R_{H/H}$ and the Log $R_{L/L}$ described above, the electric resistance environmental change ratio (A/B) of the magnetic core material was obtained according to the formula shown below.

$$A/B = \text{Log } R_{L/L} / \text{Log } R_{H/H} \quad \text{[Math. 2]}$$

Furthermore, the electric resistances ($R_{N/N}$, $R_{H/H}$ and $R_{L/L}$) of the carrier under the N/N environment, under the H/H environment and under the L/L environment were measured in the same manner as in the magnetic core material, and the electric resistance environmental change ratio (C/D) of the carrier was obtained according to the formula shown below.

$$C/D = \text{Log } R_{L/L} / \text{Log } R_{H/H} \quad \text{[Math. 3]}$$

<Image Analysis>

The magnetic core material was subjected to image analysis in the manner described below and an uneven particle ratio and an average value of ratio A were obtained. First, 3,000 pieces of magnetic core materials were observed by using a particle size and shape distribution measuring device (PITA-1, produced by Seishin Enterprise Co., Ltd.) and a perimeter and an envelope perimeter were determined by using a software (Image Analysis) associated therewith. At this time, an aqueous xanthan gum solution having a viscosity of 0.5 Pa·s was prepared as a dispersion medium, and a mixture prepared by dispersing 0.1 g of the magnetic core material in 30 cc of the aqueous xanthan gum solution was used as a sample solution. By appropriately adjusting the viscosity of the dispersion medium as described above, the state in which the magnetic core material is dispersed in the dispersion medium can be maintained, and thus, the measurement can be smoothly performed. Furthermore, as to the measurement conditions, a magnification of an (objective) lens was set to 10 times, ND4×2 were used as filter, an aqueous xanthan gum solution having viscosity of 0.5 Pa·s was used as carrier liquid 1 and carrier liquid 2, a flow rate of each liquid was set to 10 μl/sec, and a flow rate of the sample solution was set to 0.08 μl/sec.

Next, from the perimeter and envelope perimeter of the magnetic core material thus-obtained, a number distribution of the ratio A of perimeter to envelope perimeter was determined, and further, from the distribution, a ratio (uneven particle ratio) of particles having the ratio A of 1.08 or more and an average value of the ratio A were determined. Here, the ratio A was obtained according to the formula shown below.

$$\text{Ratio } A = \text{perimeter/envelope perimeter} \quad \text{[Math. 1]}$$

In the evaluation of the magnetic core material, a variation degree of surface shape cannot be expressed only by defining the average value of the ratio A. Further, it is also insufficient only to define a grain size of surface or an average size of grain boundary with respect to the average particle size. Moreover, even when the variation degree described above is expressed based on limited sampling number of ranging approximately from several tens to 300, it cannot be said that the reliability is high. Therefore, in order to solve these problems, the measurements of the perimeter and envelope perimeter were performed in the manner as described above.

Example 2

(1) Production of Magnetic Core Material

The magnetic core material and carrier were produced in the following manner. Namely, raw materials were weighed so as to attain a composition ratio after sintering being 40.0% by mole of MnO, 10.0% by mole of MgO and 50.0% by mole of $Fe_2O_3$, and with respect to the 100 parts by weight of these metal oxides, 1.5 parts by weight of $ZrO_2$ was weighed and added. As the raw material, 16.9 kg of $Fe_2O_3$, and as the MnO raw material, the MgO raw material and the $ZrO_2$ raw material, 6.5 kg of trimanganese tetraoxide, 1.2 kg of magnesium hydroxide and 0.4 kg of $ZrO_2$ were used, respectively.

(1-1) Pulverization of Calcined Product

The mixture was pulverized and mixed by a wet ball mill for 5 hours, dried, and then maintained at 950° C. for one hour to perform calcination. Water was added to the calcined product thus-obtained, the mixture was pulverized by a wet ball mill for 4 hours, and the resulting slurry was dehydrated by a screw press machine. To the cake obtained was added water, and the mixture was pulverized again by the wet ball mill for 4 hours to obtain slurry 2.

(1-2) Granulation

To slurry 2 obtained was added PVA (aqueous 20% by weight solution) as a binder in an amount of 0.2% by weight with respect to the solid content, and a polycarboxylic acid dispersant was added so as to attain a slurry viscosity of 2 poise, and then granulated and dried by a spray drier. Then, the granulated product obtained was heated at 650° C. in the air to remove the organic component such as the dispersant and the binder.

(1-3) Sintering

Then, the granulated product was maintained in an electric furnace under conditions of a temperature of 1,240° C. and an oxygen concentration of 0.3% for 6 hours to perform sintering. At this time, the temperature rising rate was set to 150° C./hour and the cooling rate was set to 110° C./hour. In addition, nitrogen gas was introduced from an outlet side of a tunnel-type electric furnace to adjust the internal pressure of the tunnel-type electric furnace from 0 to 10 Pa (positive pressure). The sintered product obtained was disintegrated by a hammer crusher, then classified by a gyro shifter and a turbo classifier to perform particle size control, and subjected to magnetic separation to separate a low magnetic force product, thereby obtaining a ferrite particle.

(1-4) Oxide Film Forming Treatment

The ferrite particle thus-obtained was maintained in a rotary atmosphere furnace kept at 500° C. for one hour to perform the oxide film forming treatment on the surface of the ferrite particle. The ferrite particle subjected to the oxide film forming treatment as described above was subjected to magnetic separation and mixing to obtain a carrier core material (magnetic core material).

Thereafter, as to the magnetic core material obtained, the production of carrier and evaluations were performed in the same manner as in Example 1.

Example 3

(1) Production of Magnetic Core Material

The magnetic core material and carrier were produced in the following manner. Namely, raw materials were weighed so as to attain a composition ratio after sintering being 10.0% by mole of MnO, 13.3% by mole of $Li_2O$ and 76.7% by mole of $Fe_2O_3$, and water was added so as to attain a solid content of 50%. Furthermore, an aqueous lithium silicate solution with 20% in terms of $SiO_2$ was added thereto so as to attain an amount of Si being 10,000 ppm with respect to the solid content. As the raw material, 21.9 kg of $Fe_2O_3$, and as the MnO raw material and the $Li_2O$ raw material, 1.4 kg of trimanganese tetraoxide and 1.8 kg of lithium carbonate were used, respectively.

(1-1) Pulverization of Calcined Product

The mixture was pulverized and mixed by a wet ball mill for 5 hours, dried, and then calcined at 1,000° C. in the air. Water was added to the calcined product thus-obtained, the mixture was pulverized by a wet ball mill for 4 hours, and the resulting slurry was dehydrated by a filter press machine. To the cake obtained was added water, and the mixture was pulverized again by the wet ball mill for 4 hours to obtain slurry 3.

(1-2) Granulation

To slurry 3 obtained was added PVA (aqueous 20% by weight solution) as a binder in an amount of 0.2% by weight with respect to the solid content, and a polycarboxylic acid dispersant was added so as to attain a slurry viscosity of 2 poise, and then granulated and dried by a spray drier. Then, the granulated product obtained was heated at 650° C. in the air to remove the organic component such as the dispersant and the binder.

(1-3) Sintering

Then, the granulated product was sintered under conditions of a temperature of 1,175° C. and an oxygen concentration of 1% by volume for 6 hours to obtain a sintered product. At this time, the temperature rising rate was set to 150° C./hour and the cooling rate was set to 110° C./hour. In addition, nitrogen gas was introduced from an outlet side of a tunnel-type electric furnace to adjust the internal pressure of the tunnel-type electric furnace from 0 to 10 Pa (positive pressure). The sintered product obtained was disintegrated by a hammer crusher, then classified by a gyro shifter and a turbo classifier to perform particle size control, and subjected to magnetic separation to separate a low magnetic force product, thereby obtaining a carrier core material (magnetic core material).

Thereafter, as to the magnetic core material obtained, the production of carrier and evaluations were performed in the same manner as in Example 1.

Example 4

The production of magnetic core material and carrier and the evaluations were performed in the same manner as in Example 1, except for using a raw material of a different lot as the $Fe_2O_3$ raw material.

Example 5

The production of magnetic core material and carrier and the evaluations were performed in the same manner as in Example 3, except for using a raw material of a different lot as the $Fe_2O_3$ raw material.

Example 6 (Comparative Example)

The production of magnetic core material and carrier and the evaluations were performed in the same manner as in Example 1, except for changing the conditions of the pulverization of calcined product to those described below. Namely, in (1-1) Pulverization of calcined product in Example 1, water was added to the calcined product, and the mixture was pulverized by a wet ball mill for 7 hours to obtain slurry 6.

Example 7 (Comparative Example)

The production of magnetic core material and carrier and the evaluations were performed in the same manner as in Example 2, except for changing the conditions of the pulverization of calcined product to those described below. Namely, in (1-1) Pulverization of calcined product in Example 2, water was added to the calcined product, and the mixture was pulverized by a wet ball mill for 7 hours to obtain slurry 7.

Example 8 (Comparative Example)

The production of magnetic core material and carrier and the evaluations were performed in the same manner as in Example 3, except for changing the conditions of the pulverization of calcined product to those described below. Namely, in (1-1) Pulverization of calcined product in Example 3, water was added to the calcined product, and the mixture was pulverized by a wet ball mill for 7 hours to obtain slurry 8.

Example 9 (Comparative Example)

The production of magnetic core material and carrier and the evaluations were performed in the same manner as in Example 1, except for changing the conditions of the pulverization of calcined product to those described below. Namely, in (1-1) Pulverization of calcined product in Example 1, water was added to the calcined product, the mixture was pulverized by a wet ball mill for 2 hours, and the resulting slurry was pressed and dehydrated by a belt press machine. The operation of adding water, pulverizing for 2 hours and dehydrating was further repeated twice similarly, and then water was added to the cake obtained, and the mixture was pulverized again by the wet ball mill for 2 hours to obtain slurry 9.

Example 10 (Comparative Example)

The production of magnetic core material and carrier and the evaluations were performed in the same manner as in Example 2, except for changing the conditions of the pulverization of calcined product to those described below. Namely, in (1-1) Pulverization of calcined product in Example 2, water was added to the calcined product, the mixture was pulverized by a wet ball mill for 2 hours, and the resulting slurry was dehydrated by a screw press machine. The operation of adding water, pulverizing for 2 hours and dehydrating was further repeated twice similarly, and then water was added to the cake obtained, and the mixture was pulverized again by the wet ball mill for 2 hours to obtain slurry 10.

Example 11 (Comparative Example)

The production of magnetic core material and carrier and the evaluations were performed in the same manner as in Example 3, except for changing the conditions of the pulverization of calcined product to those described below. Namely, in (1-1) Pulverization of calcined product in Example 3, water was added to the calcined product, the mixture was pulverized by a wet ball mill for 2 hours, and the resulting slurry was dehydrated by a filter press machine. The operation of adding water, pulverizing for 2 hours and dehydrating was further repeated twice similarly, and then water was added to the cake obtained, and the mixture was pulverized again by the wet ball mill for 2 hours to obtain slurry 11.

Results

The evaluation results obtained in Examples 1 to 11 were as shown in Tables 1 and 2. In Examples 1 to 5, which are the examples of the present invention, since the contents of anion components were small, the electric resistance environmental change ratio (A/B) of the magnetic core material was low and the environmental dependence (C/D) of the carrier resistance was also low. Furthermore, since the uneven particle ratio was low, it is expected that the resin layer is uniform when the carrier is formed and the carrier scattering caused by the peeling off of resin due to durable printing can be suppressed. In Examples 1 to 3, all of the electric resistance environmental change ratio (A/B) of the magnetic core material, the environmental dependence (C/D) of the carrier resistance, and the uneven particle ratio were low, and more excellent effects can be achieved.

On the other hand, in Examples 6 to 8, which are the comparative examples, since the contents of anion components were large, the electric resistance environmental change ratio (A/B) of the magnetic core material was high and the environmental dependence (C/D) of the carrier resistance was also high. Furthermore, in Examples 9 to 11, which are the comparative examples, since the contents of anion components were excessively small, the uneven particle ratio was high and thus, increase of the non-uniform portions in the resin layer when the carrier is formed and the carrier scattering caused by the peeling off of resin due to durable printing are matters of concern. From these results, it can be seen that according to the present invention, a magnetic core material for electrophotographic developer and a carrier for electrophotographic developer, each of which has small environmental dependence of the electric resistance, can suppress the carrier scattering, and can stably provide good images, and a developer containing the carrier can be provided.

TABLE 1

| | Magnetic Core Material | | | | | | | | | | | | |
|---|---|---|---|---|---|---|---|---|---|---|---|---|---|
| | | | Ion Content (ppm) | | | | | | | | ICP (%) | | |
| | $D_{50}$ | AD | $F^-$ | $Cl^-$ | $Br^-$ | $NO_2^-$ | $NO_3^-$ | $SO_4^{2-}$ | Formula | Formula | | | |
| | (μm) | (g/cm$^3$) | (a) | (b) | (c) | (d) | (e) | (f) | (1) | (2) | $Na^+$ | $K^-$ | $Ca^{2+}$ |
| Example 1 | 39.8 | 2.37 | 0.8 | 3.5 | N.D. | 0.4 | 0.7 | 4.2 | 41.1 | 392 | 0.01 | <0.01 | 0.01 |
| Example 2 | 36.6 | 2.34 | 0.9 | 6.9 | N.D. | 0.7 | 0.6 | 10.3 | 81.5 | 79.3 | <0.01 | <0.01 | 0.01 |
| Example 3 | 38.5 | 2.15 | 1.3 | 4.6 | N.D. | 0.5 | 1.1 | 28.1 | 77.0 | 74.1 | <0.01 | <0.01 | 0.01 |
| Example 4 | 40.1 | 2.37 | 0.9 | 1.7 | N.D. | 0.5 | 0.7 | 2.8 | 21.9 | 19.8 | <0.01 | <0.01 | 0.02 |
| Example 5 | 38.8 | 2.16 | 1.5 | 4.9 | N.D. | 0.7 | 1.0 | 82.1 | 134.3 | 131.1 | <0.01 | <0.01 | 0.01 |
| Example 6* | 40.0 | 2.37 | 0.8 | 9.2 | N.D. | 0.5 | 0.9 | 61.7 | 155.9 | 153.7 | 0.01 | <0.01 | 0.02 |
| Example 7* | 37.1 | 2.34 | 1.0 | 13.8 | N.D. | 0.6 | 1.0 | 30.0 | 170.6 | 168.0 | 0.01 | <0.01 | 0.01 |
| Example 8* | 38.6 | 2.15 | 1.7 | 6.7 | N.D. | 0.8 | 0.9 | 167 | 237.4 | 234.0 | 0.02 | <0.01 | 0.03 |
| Example 9* | 40.6 | 2.36 | 0.8 | 0.8 | N.D. | 0.4 | 0.4 | 1.9 | 11.5 | 9.9 | <0.01 | <0.01 | 0.02 |
| Example 10* | 37.3 | 2.35 | 0.5 | 1.0 | N.D. | 0.5 | 0.4 | 1.0 | 12.4 | 11.0 | 0.01 | <0.01 | <0.01 |
| Example 11* | 39.2 | 2.17 | 0.9 | 0.6 | N.D. | 0.6 | 1.0 | 1.9 | 10.4 | 7.9 | 0.01 | <0.01 | 0.01 |

*indicates the comparative example.

N.D. indicates that it was not detected.

TABLE 2

| | Magnetic Core Material | | | | | | Carrier | | | |
|---|---|---|---|---|---|---|---|---|---|---|
| | Electric Resistance (Log Ω) | | | | Image Analysis | | Electric Resistance (Log Ω) | | | |
| | L/L (A) | N/N | H/H (B) | A/B | Uneven Particle Ratio (%) | Average Value of Ratio A | L/L (C) | N/N | H/H (C) | C/D |
| Example 1 | 9.5 | 8.7 | 8.4 | 1.13 | 7.2 | 1.05 | 11.1 | 10.4 | 10.0 | 1.11 |
| Example 2 | 10.1 | 9.7 | 8.8 | 1.15 | 4.6 | 1.04 | 12.2 | 10.9 | 10.4 | 1.17 |
| Example 3 | 10.7 | 10.3 | 9.2 | 1.16 | 3.8 | 1.04 | 11.9 | 11.2 | 10.4 | 1.14 |
| Example 4 | 9.4 | 8.5 | 8.1 | 1.16 | 8.8 | 1.05 | 11.2 | 10.7 | 10.2 | 1.10 |
| Example 5 | 10.3 | 10.0 | 8.4 | 1.23 | 4.0 | 1.04 | 11.5 | 10.8 | 9.4 | 1.22 |
| Example 6* | 9.2 | 7.9 | 7.1 | 1.30 | 4.4 | 1.04 | 11.2 | 9.8 | 8.8 | 1.27 |
| Example 7* | 9.8 | 9.4 | 7.6 | 1.29 | 4.5 | 1.04 | 11.6 | 10.7 | 9.1 | 1.27 |
| Example 8* | 10.1 | 9.6 | 7.4 | 1.36 | 2.0 | 1.04 | 10.9 | 10.6 | 8.2 | 1.33 |
| Example 9* | 9.6 | 8.9 | 8.7 | 1.10 | 12.1 | 1.04 | 11.4 | 10.5 | 10.3 | 1.11 |

TABLE 2-continued

| | Magnetic Core Material | | | | | | Carrier | | | |
|---|---|---|---|---|---|---|---|---|---|---|
| | Electric Resistance (Log Ω) | | | | Image Analysis | | Electric Resistance (Log Ω) | | | |
| | L/L (A) | N/N | H/H (B) | A/B | Uneven Particle Ratio (%) | Average Value of Ratio A | L/L (C) | N/N | H/H (C) | C/D |
| Example 10* | 10.3 | 9.9 | 9.0 | 1.14 | 11.2 | 1.05 | 12.3 | 11.3 | 10.5 | 1.17 |
| Example 11* | 10.8 | 10.4 | 9.4 | 1.15 | 10.5 | 1.04 | 11.7 | 11.3 | 10.6 | 1.10 |

*indicates the comparative example

INDUSTRIAL APPLICABILITY

According to the present invention, a magnetic core material for electrophotographic developer which has small environmental dependence of the electric resistance, and can suppress the carrier scattering can be provided. Furthermore, a carrier for electrophotographic developer and a developer each of which contains the magnetic core material can be provided. Moreover, a method for producing the magnetic core material for electrophotographic developer, a method for producing the carrier for electrophotographic developer, and a method for producing the developer can be provided.

While the present invention has been described in detail and with reference to specific embodiments thereof, it will be apparent to those skilled in the art that various changes and modifications can be made therein without departing from the spirit and scope of the present invention.

This application is based on a Japanese patent application (No. 2017-162631) filed on Aug. 25, 2017, and the contents thereof are incorporated herein by reference.

The invention claimed is:

1. A magnetic core material for electrophotographic developer, satisfying a value of Formula (1): a+b×10+c+d+e+f, being from 20 to 150, when a fluoride ion amount is denoted by a (ppm), a chloride ion amount is denoted by b (ppm), a bromide ion amount is denoted by c (ppm), a nitrite ion amount is denoted by d (ppm), a nitrate ion amount is denoted by e (ppm), and a sulfate ion amount is denoted by f (ppm), which are measured by a combustion ion chromatography method.

2. The magnetic core material for electrophotographic developer according to claim 1, wherein in a number distribution of a ratio A of a perimeter to an envelope perimeter, a ratio of particles having the ratio A of 1.08 or more is 10% or less.

3. The magnetic core material for electrophotographic developer according to claim 2, wherein the ratio of particles having the ratio A of 1.08 or more is 8% or less.

4. The magnetic core material for electrophotographic developer according to claim 1, wherein the value of Formula (1) is from 30 to 100.

5. The magnetic core material for electrophotographic developer according to any one of claim 1, wherein the magnetic core material has a volume average particle diameter ($D_{50}$) being from 25 to 50 μm, and an apparent density (AD) being from 2.0 to 2.7 g/cm$^3$.

6. The magnetic core material for electrophotographic developer according to any one of claim 1, wherein the magnetic core material has a ferrite composition comprising at least one element selected from Mn, Mg, Li, Sr, Si, Ca, Ti, and Zr.

7. A carrier for electrophotographic developer comprising the magnetic core material for electrophotographic developer of claim 1 and a coating layer comprising a resin provided on a surface of the magnetic core material.

8. A developer comprising the carrier as described in claim 7 and a toner.

9. A method for producing the magnetic core material for electrophotographic developer as described in any one of claim 1, wherein the method comprises the following steps:

a step of pulverizing and mixing raw materials of the magnetic core material to produce a pulverized product, a step of calcining the pulverized product to produce a calcined product, a step of pulverizing and granulating the calcined product to produce a granulated product, a step of sintering the granulated product to produce a sintered product, and a step of disintegrating and classifying the sintered product; and wherein in the production of the granulated product, a washing operation is performed in a manner that water is added to the calcined product, followed by performing wet pulverization to form a slurry, and after dehydrating the slurry obtained, water is added again, followed by performing wet pulverization.

10. The method for producing the magnetic core material for electrophotographic developer according to claim 9, wherein in the washing operation, a step of adding water after dehydration of the slurry, followed by performing wet pulverization is repeated.

11. A method for producing a carrier for electrophotographic developer comprising:

producing a magnetic core material of claim 9; and coating a surface of the magnetic core material with a resin.

12. A method for producing a developer comprising:

producing a carrier by the method as described in claim 11 and then, mixing the carrier with a toner.

* * * * *